US005734992A

United States Patent [19]

Ross

[11] Patent Number: 5,734,992

[45] Date of Patent: Apr. 7, 1998

[54] PROTECTIVE HAND AND ARM COVERING ARTICLE

[76] Inventor: Michael R. Ross, 1415 Marlborough Rd., Hillsborough, Calif. 94010

[21] Appl. No.: 789,295

[22] Filed: Jan. 28, 1997

[51] Int. Cl.[6] ..... A41D 13/08

[52] U.S. Cl. ..... 2/161.7; 2/16; 2/161.6; 2/168

[58] Field of Search ..... 2/161.7, 161.6, 2/168, 16, 159, 158, 59, 160, 162

[56] References Cited

U.S. PATENT DOCUMENTS

| | | | |
|---|---|---|---|
| 1,280,421 | 10/1918 | Diem | 2/168 |
| 1,762,865 | 6/1930 | Heinrich | 2/168 |
| 2,244,871 | 6/1941 | Guinzburg | 2/59 |
| 3,025,403 | 3/1962 | Belknap et al. | 2/168 |
| 3,268,647 | 8/1966 | Hayes et al. | 2/168 |
| 3,327,320 | 6/1967 | Forsyth | 2/158 |
| 3,541,609 | 11/1970 | Povlacs et al. | 2/168 |
| 3,657,741 | 4/1972 | Blanco | 2/59 |
| 3,994,643 | 11/1976 | Joslin et al. | 425/110 |
| 4,095,293 | 6/1978 | Heavner et al. | 2/168 |
| 4,133,624 | 1/1979 | Heavner et al. | 425/275 |
| 4,464,796 | 8/1984 | Heissenberger et al. | 2/168 |
| 4,845,780 | 7/1989 | Reimers et al. | 2/160 |
| 4,881,277 | 11/1989 | Hogle | 2/169 |
| 4,884,300 | 12/1989 | Vistins | 2/162 |
| 4,918,754 | 4/1990 | Leatherman et al. | 2/16 |
| 4,924,530 | 5/1990 | Tagaya | 2/163 |
| 4,937,881 | 7/1990 | Heise | 2/158 |
| 4,942,626 | 7/1990 | Stern et al. | 2/161.7 |
| 4,967,419 | 11/1990 | Elliott | 2/16 |
| 5,014,362 | 5/1991 | Tillotson et al. | 2/168 |
| 5,044,493 | 9/1991 | Crawford et al. | 206/293 |
| 5,088,123 | 2/1992 | MacDonald | 2/162 |
| 5,143,762 | 9/1992 | Ho | 428/35.7 |
| 5,186,322 | 2/1993 | Harreld et al. | 2/159 |
| 5,317,759 | 6/1994 | Pierce | 2/161.7 |
| 5,335,373 | 8/1994 | Dangman et al. | 2/161.7 |
| 5,357,636 | 10/1994 | Dresdner, Jr. et al. | 2/161.7 |
| 5,361,415 | 11/1994 | Deering et al. | 2/158 |
| 5,370,900 | 12/1994 | Chen | 427/2.3 |
| 5,402,536 | 4/1995 | Matthews | 2/59 |
| 5,442,816 | 8/1995 | Seketa | 2/161.7 |
| 5,575,014 | 11/1996 | Kane et al. | 2/16 |

FOREIGN PATENT DOCUMENTS

| | | | |
|---|---|---|---|
| 2237975 | 5/1991 | United Kingdom | 2/16 |

OTHER PUBLICATIONS

1996 Wholesale Distributors Catalog from Champaign Plastics Company, Champaign, Illinois.

A sample of Part No. 905 Plastic Glove from Champaign Plastics Co, Champaign, Illinois.

A sample of Convertors Sterile Sleeve, Catalog No. 599 from Baxter Healthcare Corporation, Deerfield, Illinois.

A sample of Triflex® Sterile Latex Surgeon's Glove, from Baxter Healthcare Corporation, Valencia, California.

*Primary Examiner*—Amy B. Vanatta

*Attorney, Agent, or Firm*—Fish & Neave; Nicola A. Pisano

[57] ABSTRACT

An extended protective article capable of covering an upper extremity of a wearer from the hand and up to a region near the axilla, and providing protection from fluids from its distal to its proximal ends; the protective article can be formed of a single material or two components of dissimilar materials; a method for constructing the protective article is also provided.

12 Claims, 4 Drawing Sheets

PROTECTIVE HAND AND ARM COVERING ARTICLE

TECHNICAL FIELD

This invention concerns protective articles for use in handling fluids contaminated with fluid-borne pathogens. More particularly, the present invention concerns surgical gloves and examination gloves that cover the hand and a portion of the arm to provide a barrier to transmission of fluid-borne pathogens, yet permit transmission of tactile sensations to a wearer's hands and relatively unrestricted hand and arm movement.

BACKGROUND OF THE INVENTION

Protective gloves have traditionally been used for medical and surgical procedures and examinations. Such protective gloves serve two fundamental functions: to protect patients by maintaining sterility, and to reduce the transmission of fluid-borne pathogens from the patient to the individual wearing the gloves. Such gloves are generally fluid-impermeable and are designed to allow the wearer the greatest amount of tactile sensation and a range of motion of the hand. Standard protective gloves of this type generally cover the hand and extend to the wrist or distal-most forearm.

In a health care context, when a wearer uses gloves that extend from the hand to the wrist or distal forearm and performs a sterile procedure, it is common for the uncovered aspect of the wearer's contralateral arm to contaminate the sterile gloved portion during the procedure. If this is recognized, the wearer will change to new, sterile gloves. However, if this breach of sterility is not recognized, sterility is compromised and there is risk of infection.

Contamination of the sterile portions of gloves can only be minimized by having the person who is to perform a procedure wear sterile gloves along with a full, sterile surgical gown. Complete sterile gowning is difficult to achieve and is generally only undertaken for procedures in operating rooms and for selected special procedures (e.g., angiography). The vast majority of sterile procedures, however, are performed with the health care worker wearing only gloves, leaving the upper arms and at least a substantial portion of the forearms exposed to, and as potential causative sources of, infection.

Protective gloves that facilitate transmission of tactile sensation are also worn by individuals in settings other than sterile health care settings. Due to an alarming increase in both the pathogenicity and virulence of infectious diseases (e.g., AIDS, hepatitis, and Ebola viruses), protective gloves are now commonly worn by health care workers, support staff, law enforcement officers, military staff, paramedics and others that come into contact with blood or other body fluids. In these non-sterile contexts, gloves are typically worn to protect the wearer from pathogens which can be transmitted from an individual being attended to.

Thus, when police officers, fire fighters, paramedics and health care workers attend injured or otherwise ill patients, there is near universal use of the same type of gloves used in sterile medical settings; the gloves are worn to protect the provider of assistance as opposed to the patient. Once again, the upper arms and at least a substantial portion of the wearer's forearms are exposed, and are readily fluid-contaminated with blood or other bodily substances.

Accordingly, current gloves that are fluid-protective only provide protection at the level of the wrist or, at most, the mid-forearm. Existing protective gloves which extend beyond the wrist are often disadvantageous since they bind and restrict movement at the wrist, or are uncomfortable when worn over clothes. Commonly, such protective gloves are formed of molded latex or rubber and are not applicable to sterile use and transmission of tactile sensation.

Disposable sleeves are known for use with previously known wrist-length gloves to provide a measure of protection against contamination of the upper arm, and in addition, may provide sterile cover for the upper arms for use in surgical applications. Such sleeves, which are generally made of polyethylene, spun polypropylene, or Tyvek®, include a tubular sleeve having an elastic band at either end. An example of such a non-sterile sleeve is Model No. 260 Disposable Sleeve, manufactured by Champaign Plastics Co, Champaign, Ill.; an example of a sterile sleeve is the Convertors® Sterile Sleeve, Cat. No. 599, manufactured by Baxter Healthcare Corporation, Deerfield, Ill.

A drawback of such disposable sleeves is that they generally must be donned after the wearer dons the wrist length glove, thus creating the opportunity for the sterile glove to contact non-sterile surfaces when the sleeves are donned. Such sleeves offer little resistance to seepage of contaminated fluids where the distal end of the sleeve meets the glove. In addition, the additional time required to separately don sleeves does not lend itself to use in time-critical emergency situations.

Full-length gloves are known for use in veterinary applications, for example, treatment and artificial insemination of large animals, such as cows, that comprise a hand portion and a portion that extends up to the shoulder of the wearer. An example of such gloves, is the Shoulder Length Glove, Model No. 905, manufactured by Champaign Plastics Co., Champaign, Ill. These gloves are generally formed of polyethylene and are intended primarily to protect the clothes of the individual wearing the gloves. The gloves are neither sterile, fluid impermeable, nor do they provide adequate transmission of tactile sensation to enable their use in medical procedures.

In view of the foregoing, it would be desirable to provide a protective article having a glove portion that provides satisfactory transmission of tactile sensation and an attached extended portion that covers that arm of the wearer.

It would also be desirable to provide a protective article having a glove portion and an attached extended portion that covers the arm and which provides a barrier between fluid-borne pathogens and the arm of the wearer.

It would further be desirable to provide a protective article having a glove portion and an extended portion that covers the arm and wherein the glove portion and extended portion are sterile, thereby reducing the risk of infection from the forearms and the need to change gloves.

SUMMARY OF THE INVENTION

In view of the foregoing, it is an object of the present invention to provide a protective article having a glove portion that provides satisfactory transmission of tactile sensation and an attached extended portion that covers that arm of the wearer.

It is another object of the present invention to provide a protective article having a glove portion and an attached extended portion that covers the arm and which provides a barrier between fluid-borne pathogens and the arm of the wearer.

It is yet a further object of this invention to provide a protective article having a glove portion and an extended portion that covers the arm and wherein the glove portion and extended portion are sterile, thereby reducing the risk of infection from the forearms and the need to change gloves.

The article constructed in accordance with the present invention provides a continuous sterile area that protects the wearer's hand, wrist, forearm, elbow and portions of the upper arm below the shoulder from exposure to fluid-borne pathogens. The article constructed in accordance with this invention also provides all of the functionality of existing medical and surgical gloves, including a snug, form-fit on the hand and wrist required for full dexterity and transmission of tactile sensation.

In a first embodiment of the article of this invention, the glove and arm portions comprise a fluid impermeable material that provides transmission of tactile sensation at least in the glove portion. In an alternative embodiment, the glove portion and arm portion of the article comprise different materials, so that at least the glove portion provides the tactile sensation and manual dexterity required by health care gloves. Means are also provided for cinching the extended portions of the gloves in the vicinity of the wrist and upper arm so as to prevent the extended portion of the article from inadvertently entering the sterile field. Methods of producing such protective articles are also disclosed.

BRIEF DESCRIPTION OF THE DRAWINGS

Further features of the invention, its nature and various advantages will be apparent from the accompanying drawings and the following detailed description of the preferred embodiments, in which.

DETAILED DESCRIPTION OF THE INVENTION

In overview, the present invention provides a protective article comprising a glove-like component and a component that extends protective coverage to well above the wrist and distal forearm typically to the proximal portion of the upper arm. Protective articles in accordance with the invention afford greater protection to both patients and health care workers as well as the other personnel for whom fluid and pathogen protection is indicated. The invention maintains all the advantages of previously known form-fitted molded health care gloves. As used herein, health care gloves are gloves designed for use in sterile medical contexts (to prevent contamination of a sterile field on a patient, and to protect the wearer from fluids and infectious agents), and gloves used in non-sterile settings to prevent infection of the glove wearer.

Conventional surgical gloves are made in a range of sizes to provide a snug fit with a high degree of transmission of tactile sensation, and are typically packaged in a sterile condition, two matched gloves to a package. Surgical gloves may be formed of latex, neoprene, vinyl or nitrile. Examination gloves, by contrast, are often ambidextrous, non-sterile, packaged in quantity, and come in only a few sizes (e.g., small, medium and large). Other types of medical gloves are also known, such as orthopedic gloves and microsurgical gloves. Microsurgical gloves are used with microsurgical instruments and are generally thinner than standard surgical gloves to provide greater transmission of tactile sensation. The present invention may be advantageously used in all of the foregoing applications.

Figure 1:
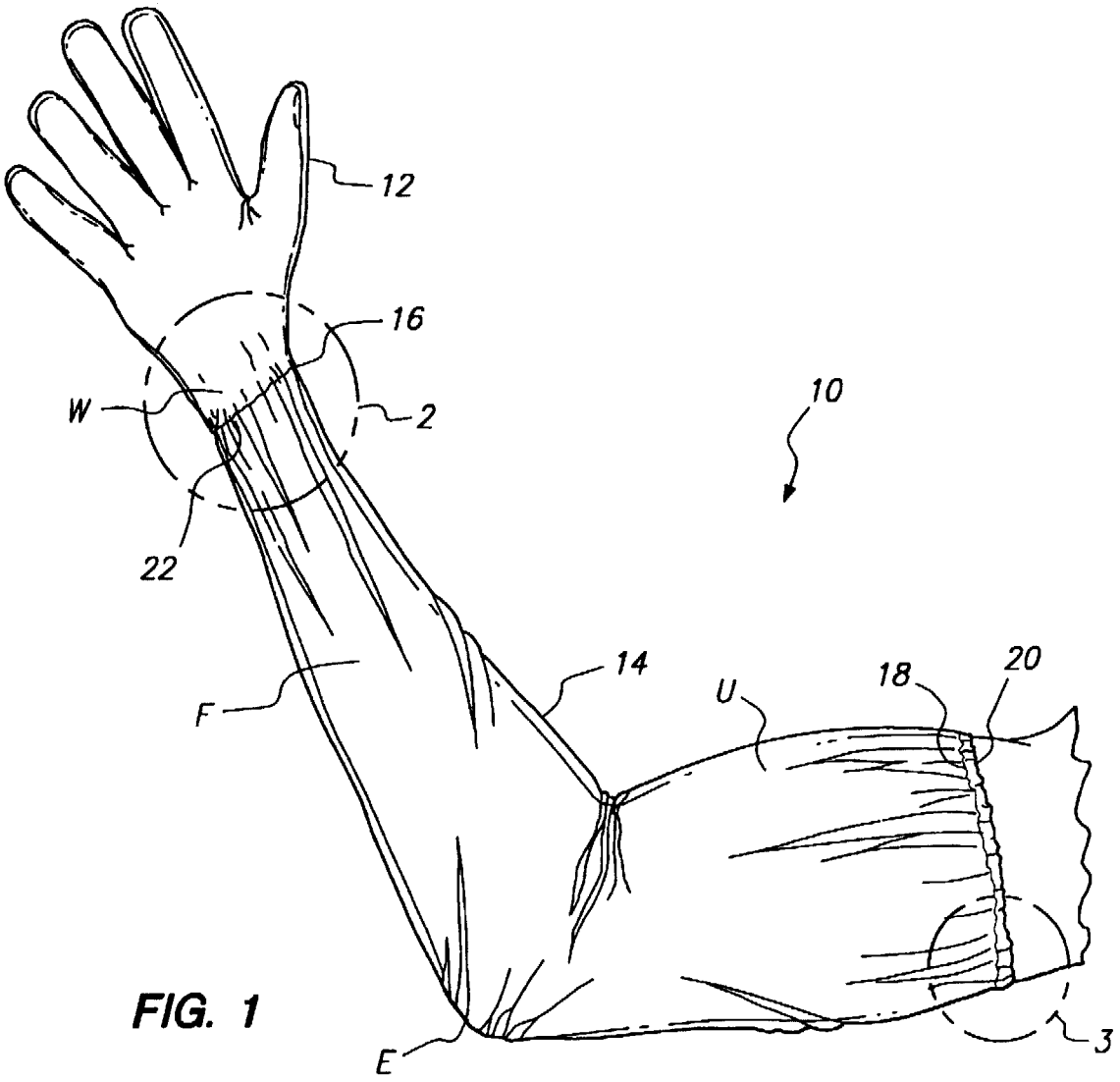
FIG. 1 is a frontal view of a flexed right arm of an individual wearing an article in accordance with the invention.

Referring to FIG. 1, an illustrative embodiment of a protective article in accordance with the invention is described. Protective article 10 has a distal portion 12 and proximal portion 14 that extends to fully cover forearm F and at least a portion of upper arm U past elbow E. Protective article 10 includes means for cinching 16, for example, an elastic band, to gather the glove snugly to the arm in the vicinity of wrist W. Similarly, structure 18, which may also be an elastic band, is provided adjacent to proximal end 20 of protective article 10 for cinching proximal end 20 of the article to the upper arm of the wearer.

In accordance with the present invention at least distal portion 12 of protective article 10 comprises a material that is both fluid impermeable and capable of transmitting tactile sensation. For example, distal portion 12 may comprise molded neoprene, a vinyl compound, nitrile, rubber or latex. Proximal portion 16 comprises a similar or different material than distal portion 12, and is also fluid impermeable.

Cinching means 16 and 18 of protective article 10 may comprise, for example, an elastic band, drawstring, snap, adhesive tape, VELCRO or other structure to allow the article to fit snugly around the wrist or upper arm. Alternatively, if distal portion 12 of protective article 10 comprises a highly elastic material, such as a natural or synthetic rubber or a latex compound, the distal portion may have sufficient resiliency in the region of wrist W so as to make provision of cinching means 14 unnecessary.

In a first family of embodiments of protective article 10, distal portion 12 and proximal portion 14 are constructed from different pieces of material comprising different types of material. For example, distal portion 12 may comprise an elastic material such as neoprene or latex, while proximal portion 16 may comprise vinyl, polyethylene, polyvinyl chloride or nitrile. In one such embodiment, distal portion 12 is joined to proximal portion 16 to form a fluid-tight bond 22 in the vicinity of wrist W. Proximal portion 16 may extend for any distance above the distal forearm to and preferably above the elbow. For example, proximal end 20 of protective article 10 may terminate near the axilla.

Materials and methods for construction of a protective article of the invention will now be discussed. For convenience, distal portion 12 will also be referred to as a "glove portion" and proximal portion 14 will also be referred to as an "arm portion." As just described, in a first family of embodiments the glove portion comprises a different material than that of the arm portion; in an alternative family of embodiments, the glove and arm portions may comprise the same material.

Still referring to FIG. 1, in a preferred embodiment of protective article 10, the material of glove portion 12 comprises an elastic material, such as neoprene, a latex compound or a natural or synthetic rubber compound, such as conventionally used for health care gloves. The material of the glove portion is preferably between 0.006 and 0.009 inch. Analogous to the manufacture of standard health care gloves, the glove portion is preferably formed by dipping molded hand forms into liquid latex or rubber material, curing and then removing the cured glove portion from the form. An art-recognized range of hand-shaped forms are used so as to produce a glove portion/distal portion which fits the range of hand sizes in the general public.

Arm portion 14 is preferably formed of a fluid impermeable, thin, flexible plastic or synthetic material, for example polyethylene, polyvinyl chloride, vinyl or nitrile. Materials of this type are commercially available and are often used to construct surgical drapes, gowns and examination gloves. In one embodiment of the arm portion, the arm portion is constructed of a fluid-impermeable material having a tubular configuration. The arm portion is attached to the glove portion with a fluid-impermeable seal around the circumference of the proximal portion of the glove portion. Relative to the glove portion, the arm portion is of a size to fit somewhat loosely about the wearer's upper extremity.

In particular, the arm portion has a circumferential area of a size that fits comfortably around the arm, but not of a size so large as to undesirably fall into a sterile field or fall onto the glove portion. The arm portion has a sufficient native circumference so as to allow essentially full range of upper extremity motion, yet is not so large as to fall onto the glove portion, or to inadvertently fall into a sterile field. Preferably, the arm portion will have a circumference between 10 cm and 30 cm.

At the connection between arm portion 12 and glove portion 14, protective article 10 of the invention is cinched down snugly around the wearer's forearm F in the vicinity of wrist W. Snug cinching of the cinched area around the wearer's forearm is advantageous; if this area were not in close approximation to the wearer's extremity, the relatively full material of the arm portion might interfere with the motion of the wearer's hand.

Figure 2:
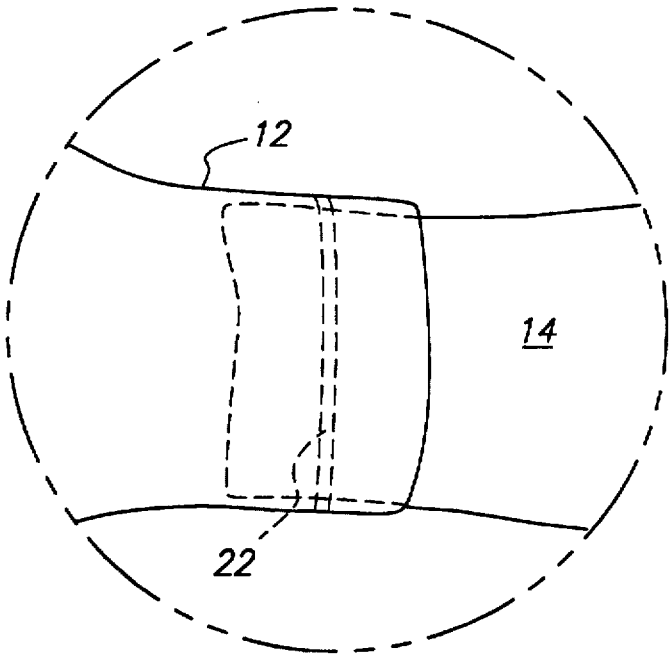
FIG. 2 is a detailed view of the bond site of the article depicted in FIG. 1.

Referring to FIG. 2, glove portion 12 and arm portion 14 are attached at site 22 in a manner that permits expansion so that the wearer's hand can be passed through. Preferably, the area at the wearers wrist at site 22 will generally expand up to 1.5–5 times its native circumference. As seen in FIG. 2, glove portion 12 preferably extends outside of arm portion 14 and is affixed thereto by conventional means, such as a suitable adhesive, ultrasonic welding or heat welding technique to provide a fluid impermeable bond. Alternatively, the joint may be formed by sewing the components together, followed by impregnating the stitching with a suitable fluid impermeable epoxy or resin.

Figure 3:
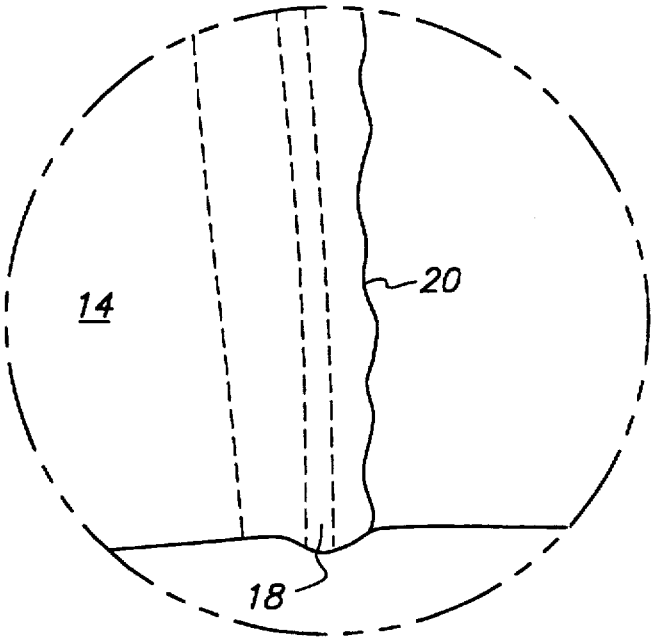
FIG. 3 is a detailed view of the proximal end of the article of FIG. 1 depicting exemplary structure for cinching the proximal end of the article to a wearer's upper arm.

Referring now to FIG. 3, arm portion 14 is sized so as to have the ability to be pulled over other garments, and is comfortable to wearers when worn over other clothing items, similar to any garment type sleeve used in surgical gowns or attire. The arm portion remains loose as compared to the glove portion. One preferred structure for maintaining the position of proximal end 20 of arm portion 14 relative to the wearer's upper arm is cinching means 18, which comprises an elastic or rubber band that is glued, sewn or bonded to the proximal end, or is incorporated into a rollover of the proximal end. Cinching means 18 at proximal end 20 of arm portion 14 is sized so that the proximal end cinches down comfortably but snugly at the upper arm; it allows for easy expansion of the proximal end of the arm portion when putting the glove on so it can pass over the widest aspect of the upper extremity, the hand.

Figure 4A:
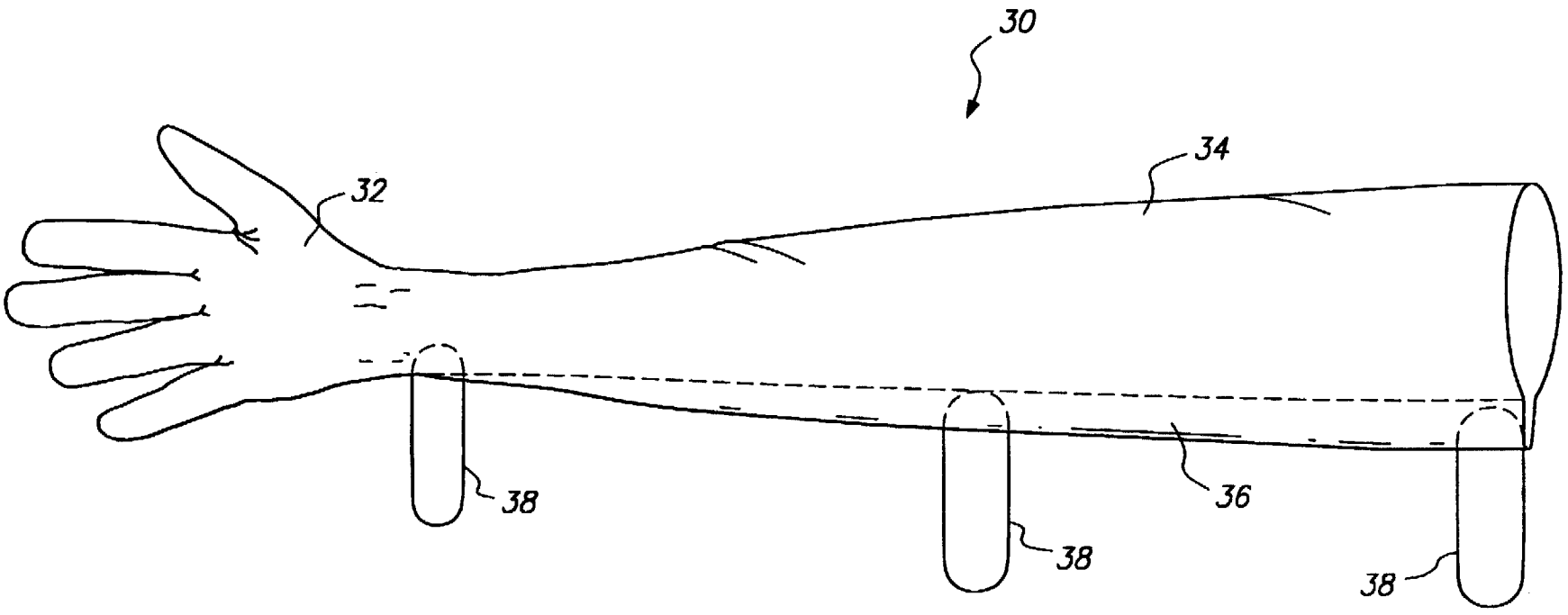
FIGS. 4A and 4B are, respectively, a frontal view of an alternative embodiment of an article constructed in accordance with the present invention, showing alternative means of cinching the article in the vicinity of the wrist and upper arm, and a view of the article disposed on the arm of an individual wearer.

Referring now to FIGS. 4, an alternative family of embodiments of protective article 30 in accordance with the invention is described. In the embodiments of FIGS. 4 protective article 30 comprises a single piece of elastic material, such as neoprene, other natural or synthetic rubber compound, or latex material of a type used in standard health care gloves. As distinguished from previously known health care gloves, the protective article of the present invention does not terminate proximally near the wearer's wrist, but extends to the wearer's upper arm.

In accordance with the present invention the single piece article 30 has glove portion 32, arm portion 34, slack portion 36 and cinching means 38 spaced apart on slack portion 36. Glove portion 32 covers the hand and is sized and molded in accordance with knowledge known in the art to provide high levels of tactile sensation and dexterity. Extending proximally from the wrist, arm portion 34 of the article has a substantially larger circumference than the wrist, and includes slack portion 36 which is sized to be larger than the average diameter of the forearm and upper arm for specified body types. In particular, arm portion 34 has a circumference (including that of slack portion 36) which is preferably one-and-a-half to five-times greater than that of the wrist region.

As with the embodiment of FIG. 1, the circumference of arm portion 34 is sufficiently large so as to fit over clothing, yet is not so large so that the arm portion falls onto a sterile field. Cinching means 38, which may comprise, for example, adhesive straps, VELCRO hook and pile strips, snaps, hook and eyelets, or string ties, are provided to form fit arm portion 34 snugly to the wearer's forearm and upper arm.

Figure 4B:
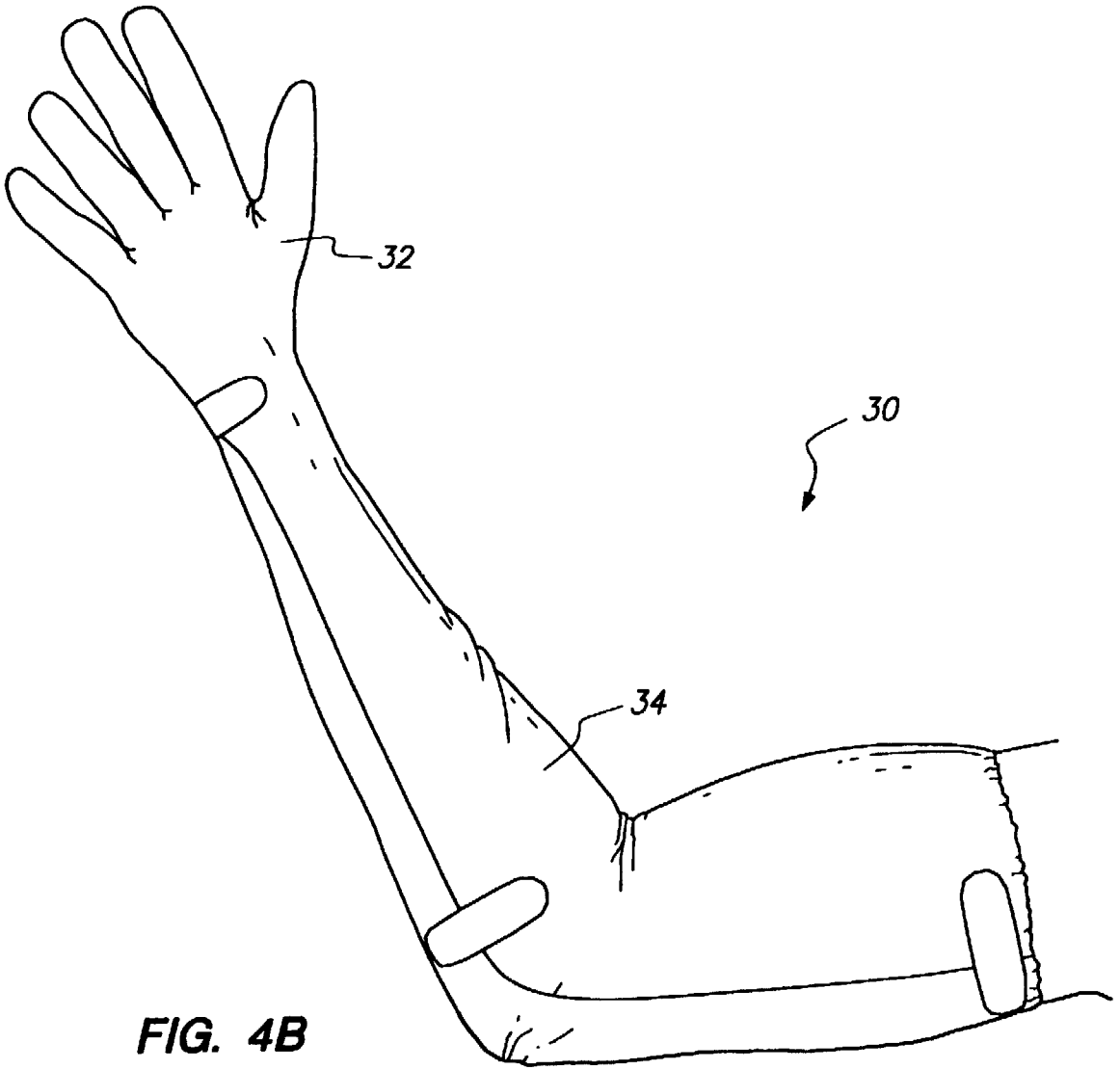

With reference to FIG. 4B, when donning the protective article, the wearer first inserts his hand through the arm portion into the glove portion. Slack portion 36 is then folded longitudinally against the remainder of arm portion 34, and arm portion 34 is fastened snugly into place using cinching means 38. Accordingly, slack portion 36 of arm portion 34 facilitates in donning protective article 30, yet may be folded against the remainder of arm portion 34, and retained there by deploying cinching means 38. Consequently, cinching means 38 retain arm portion 34 snugly against the wrist, forearm and upper arm, while ensuring that the arm portion of the protective article is held clear of the sterile field.

Modes of manufacture of the preferred embodiments of the article are now disclosed. In accordance with the first family of embodiments of FIG. 1, the glove portion is manufactured in accordance with the methods per se known for the manufacture of health care gloves and typically involves the dipping of forms of industry-defined glove sizes into molten latex or rubber compositions. These modes of manufacture comprise use of a spreading device. In one embodiment, a spreading device has a generally cylindrical component which is capable of providing different circumferential areas. Namely, the spreading device is capable of sustaining a first and a larger second circumference. The first circumference is incrementally smaller than the native circumference of the wrist portion of a health care glove; the second circumference closely corresponds to the native circumference of the arm portion of the glove.

The spreading device provides shapes of various circumferential areas, for example, by use of a fluid-filled balloon component which has sufficient rigidity at a first diameter so that a health care glove can be readily placed thereon. Alternatively the spreading device can comprise a substantially rigid device formed by material such as metal or plastic; this embodiment is narrower distally and wider proximally; the health care glove is rolled on at the distal of the spreading device and the wrist portion of the glove becomes expanded as it is rolled onto the wider proximal portion of the device. Again the wrist portion of the glove is expanded to a degree such that its circumference corresponds to the larger native circumference of the arm portion. Thus, the wrist portion of the glove is expanded by use of a spreading device. Such expansion provides a smooth essentially firm or rigid surface area on the glove to which the sleeve/arm portion is attached.

In the above-described embodiment, the arm portion is attached to the glove portion of the article by adhesive bonding with a liquid adhesive or flexible cement. In a preferred embodiment, the sleeve is bonded to the wrist of the glove portion with a neoprene-based contact cement comprising nonphotoreactive chemical solvents. The glove and arm portions are allowed to cure with the system held in the expanded state. Alternatively, the glove and arm are heat sealed to one another in accordance with art-recognized procedures. It is preferred that there be a liquid tight, and more preferably fluid tight, seal between the glove and arm portions.

Upon curing or mechanical fastening, the spreading device is reduced to one of its smaller circumferential areas, or otherwise removed, and it is withdrawn through the sleeve which as open proximally. Upon removal of the joined glove and arm portions from the spreading device, the protective article retracts back to the native state of expansion of the glove portion at the wrist area, and the rest of the sleeve remains at its normal wider circumference. Pleat-like folds at bonded area 18 occur upon elastic recoil of the glove portion. Thus, attachment of the arm and glove portions in this manner produces an article with pleats of arm material at the cinched area. Even with relaxation/elastic recoil there is a seal at the wrist; the pleated folds of the seal allow expansion so that a wearer can pull the completed product over his or her hand. As noted herein, the expansion is preferably on the order of 1.5- to 5-times the native circumference of bonded area 18. Since the seal at or near the wrist shrinks down to the original circumference of the glove portion, the article has the standard tightness and grip at this area and glove roll down is not a problem.

The mechanism for retaining the proximal-most aspect of the protective article on the upper arm of a wearer may be achieved by attaching to the proximal end of the arm portion a mechanical fastener such as, but not limited to,: VELCRO, elastic band, snaps, or drawstring, as described with respect to FIGS. 3 and 4. Such fasteners are attached in accordance with standard methods.

Modes of manufacture of the second family of embodiments of FIG. 4 are similar to that described above for the glove portion of FIG. 1. However, it is expected that the protective article is formed on a mold having an extended portion forming the arm portion and slack portion 36. Cinching means 38, for example, strips of removable adhesive tape or VELCRO strips, are then permanently affixed at one end along the length of the arm portion beginning near the wrist.

As will be apparent to one of skill in the art of medical glove design, the article in accordance with the present invention may be advantageously employed as a surgical glove, examination glove, or in other applications where it is desired to provide extended coverage of the wearer's limb.

It will be understood that the foregoing embodiments are merely illustrative of the protective article and methods of making of the present invention, and that various modifications can be made by those skilled in the art without departing from the scope and spirit of the invention.

What is claimed is:

1. An article for protecting the upper limb of a human from exposure to fluid-borne pathogens, the article comprising:

a glove portion, the glove portion having a thickness of between 0.006 and 0.009 inch;

an arm portion;

a cinched area located between the glove portion and the arm portion, the cinched area comprising a fluid impermeable connection between the glove portion and the arm portion, the cinched area capable of moving between a relaxed native circumference and an expanded circumference at least 1.5-times that of the native circumference; and, means for retaining located at a proximal portion of the arm portion, wherein the glove portion comprises a first material and the arm portion comprises a second material different than the first material.

2. The article as defined in claim 1 wherein the glove portion comprises an elastic material capable of transmitting tactile sensation.

3. The article as defined in claim 1 wherein the arm portion further includes a slack portion, the means for retaining comprising means for cinching the article in the slack region.

4. The article as defined in claim 1, wherein the proximal portion of the arm portion terminates at a point extending beyond the elbow when donned.

5. The article as defined in claim 1 wherein the arm portion further includes means for cinching the article in a region intermediate the cinched area and the proximal portion.

6. The article as defined in claim 1 wherein the article is presterilized.

7. The article as defined in claim 1 wherein the cinched area further comprises a band of elastic material.

8. The article as defined in claim 1 wherein the first material comprises an elastic material, and the cinched area comprises a proximal region of the glove portion.

9. The article as defined in claim 1 wherein the first material comprises a material selected from the group consisting of: neoprene, a vinyl compound, nitrile, rubber and latex.

10. The article as defined in claim 1 wherein the second material comprises a material selected from group consisting of: neoprene, a vinyl compound, nitrile, rubber, polyethylene or polyvinyl chloride.

11. The article as defined in claim 1 wherein the means for retaining comprise means selected from the group consisting of: straps having hook and pile closures, a drawstring, an elastic band and an adhesive band.

12. The article as defined in claim 5 wherein the means for cinching comprise means selected from the group consisting of: straps having hook and pile closures, a drawstring, an elastic band and an adhesive band.

* * * * *